United States Patent [19]

Day

[11] Patent Number: 4,475,140

[45] Date of Patent: Oct. 2, 1984

[54] SWITCHING AMPLIFIER WITH HIGH IMPEDANCE INPUT

[76] Inventor: Harry W. Day, 28306 Industrial Blvd., Hayward, Calif. 94545

[21] Appl. No.: 469,905

[22] Filed: Feb. 25, 1983

[51] Int. Cl.[3] ..... H01H 47/32

[52] U.S. Cl. ..... 361/205; 361/178; 361/188

[58] Field of Search ..... 361/205, 178, 188; 307/118

[56] References Cited

U.S. PATENT DOCUMENTS

| | | | |
|---|---|---|---|
| 3,337,777 | 8/1967 | Schwanenflugel | 361/205 X |
| 3,379,939 | 4/1968 | Obenhaus | 361/188 |
| 4,225,899 | 9/1980 | Sotiriou | 361/188 |

*Primary Examiner*—Reinhard J. Eisenzopf
*Attorney, Agent, or Firm*—Joseph L. Strabala

[57] ABSTRACT

A power control relay with a solid state switching device being arranged to control the current to the coil of the relay in a series circuit therewith can be operated safely and reliably in manufacturing environments by control thereof with a floating voltage developed by the secondary of a low voltage transformer with one side of the secondary connected to the gate of the solid state switching device through a diode and the opposite side of the secondary being controlled by a resistive probe circuit, which when grounded, will cause a voltage to be impressed on the gate that will cause the switching device to trigger thereby operating the relay due to the differential impedance developed in the floating voltage circuit arrangement.

7 Claims, 2 Drawing Figures

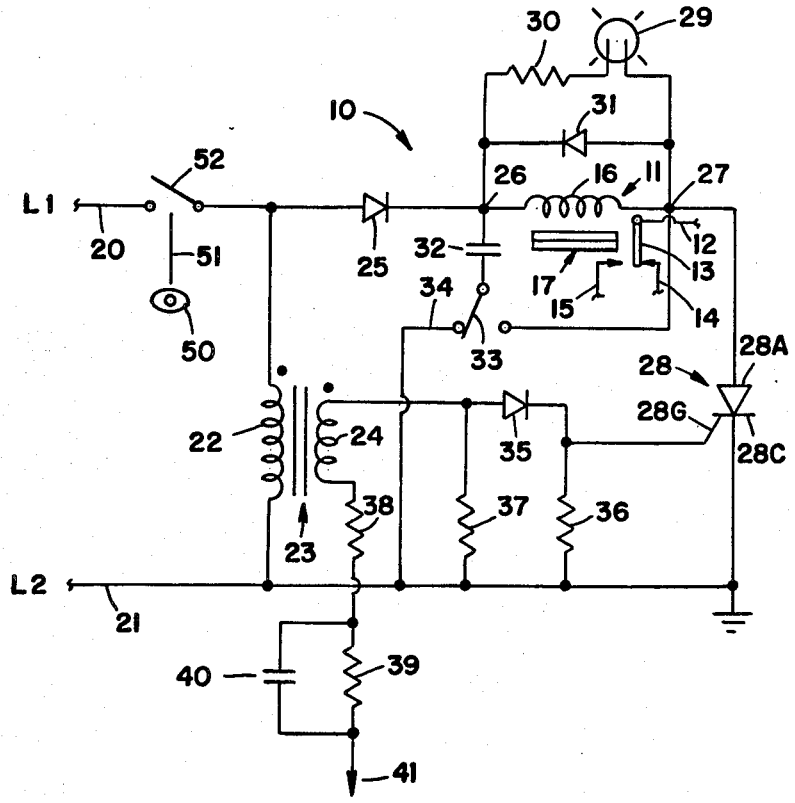

SWITCHING AMPLIFIER WITH HIGH IMPEDANCE INPUT

BACKGROUND

Relays are used in a variety of control functions in manufacturing operations, such as controlling machines, motors, sequences, etc. However, it is necessary to operate these relays by a safe and reliable control circuit. Particularly important is the isolation of the control circuitry for the relay from the power circuits that are controlled by the relay contacts. If such isolation is not properly achieved, shorts or other electrical malfunctions in the circuits can endanger, and even kill, workmen using machinery equipped with such control relays.

Electrical isolation is not the only concern since improper operation of the control relay may also place the operator of such machinery in jeopardy, as well as endanger the equipment itself.

To increase reliability higher voltage and current have often been used in the relay control circuits leading to a situation whereby direct sensing of conductive parts for relay control can lead to etching, as well as increase the danger of electrical shock.

The current invention solves the above problems with a differential impedance circuit that provides full isolation from the relay power circuits and exceptional reliability in the control circuits for operating the relay.

Not only does the instant invention solve the above problems, but it does so economically.

By using what might be characteristically described as "differential impedance switching" employing a floating voltage to control the gate of a silicon controlled rectifier or similar switching device the above objects can be realized. While in retrospect the circuits of the invention appear to be simple, their function and operation is a unique departure from prior art arrangements. The specialized circuit ensures positive and consistent operations of the relay with voltage potentials in the control circuit of 10 volts or less.

There are many applications for this very versatile device. The solid state input circuit has high impedance (10K ohms), low energy (Open Circuit Voltage (OCV) of $\pm 10$ volts peak). The relay outputs offer flexibility, total circuit isolation and use of indestructible DPDT relays, capable of driving solenoids, large motor, starters or small motors directly. These characteristics combined with the low price and ease of installation makes this invention the logical choice to solve thousands of control problems.

The novel unit is a control switching device, actuated by the touch of its low voltage high impedance input lead (probe) to ground potential. The acquisition and logic functions are of a high speed solid state design and provide either momentary or latching action. The relay output contacts can yield maximum ruggedness and flexibility in all applications. The unit can also be designed to plug into a standard 11-blade relay socket, and has no adjustments or controls. It is maintenance free and is powered directly by the 120-volt, 60 Hz line so it requires no separate power supply, rectifiers, or transformer. It is capable of a compact design which permits its mounting in existing control panels or near its point of use.

SUMMARY OF INVENTION

A switching amplifier unit having a high impedance control input according to this invention includes a transformer having a primary and a secondary with the secondary operable to provide a lower voltage output than the input voltage of the primary, a relay with a coil and having an armature with contacts controlled thereby for operating circuits external to the unit with the relay having its coil connected in parallel with the primary of the transformer in a circuit operable to provide an alternating current when connected to a power source, a solid state switch having a control gate with the solid state switch connected in series with the relay coil in the circuit, a gate control circuit connected to one side of the secondary of the transformer with a diode connected between the one side of the secondary and the control gate with the gate control circuit operable to develop a low impedance any time the other side of the secondary is not grounded, and a probe circuit including a series connected resistor connected to the other side of the secondary operable to cause the gate control circuit to develop a high impedance when the probe circuit is grounded whereby an operable voltage is developed in the gate control circuit which is sufficient to trigger the solid state switch and activate the relay.

DESCRIPTION OF THE DRAWINGS

The invention will be better understood in reference to the appended drawings taken in conjunction with the description and specification, said drawings being described as follows:

FIG. 1 is a circuit schematic of the novel switching amplifier unit of this invention showing the various components thereof; and FIG. 2 is a broken-away perspective showing the novel switching amplifier unit utilized in a machine control environment to illustrate one application, among many, of the novel switching amplifier.

DESCRIPTION OF THE PREFERRED EMBODIMENT

FIG. 1 is a schematic of the novel switching amplifier unit 10. At the heart of the unit is a standard double-pole double-throw (DPDT) relay 11 capable of controlling power to small motors directly or large motors through heavy duty solenoids. For purposes of illustration, only one pole of this relay is shown in the drawing. In reference thereof, switch lead 12 is connected to contacts on the relay armature 13 which is spring-biased (not shown) against the normally closed (NC) contact 14. When the relay 11 is energized, the normally open (NO) contact 15 is then connected to the switch lead 12 as the armature closes. The other pole of the relay (not shown) is identically constructed, and it is to be appreciated that all contacts of the relay are electrically insulated from one another except through the contact points of the relay.

Relay 11 includes a coil 16 wound on a core 17 and through the switching functions accomplished by its armature 13, controls machine operations by turning power on or off to various machine components such as other relays, motors, solenoids and the like by opening and closing the contacts of the relay.

Operation of the relay is accomplished by the novel circuit included in the schematic in FIG. 1. Power for this circuit is provided on supply leads 20 and 21, with the latter lead being the grounded side of a 110/120 volt AC supply source. The primary 22 of the transformer 23 is connected across the supply leads 20 and 21 and the secondary 24 of this transformer provides an 8-volt output for the floating control voltage circuit described hereinafter.

Power supply lead 20 is also connected with the anode of diode 25 which has its cathode connected to one terminal 26 of the coil 16 of relay 11 thereby providing half-wave rectified voltage (pulsating DC) to terminal 26. Terminal 27 of this coil is connected to the anode 28(A) of a silicon-controlled rectifier (SCR) 28 that has its cathode 28(C) connected to the grounded side of the circuit, i.e., supply lead 21.

As to the above-described portions of the circuit, it can be appreciated that when the gate 28(G) of the SCR 28 triggers the SCR, the coil 16 of relay 11 will be energized with 110/120 volts pulsating DC. Further, this coil will be energized as long as the SCR remains conductive.

To visually indicate the switching condition of the relay, a neon bulb 29 is connected in series with the dropping resistor 30 of approximately 180K ohms and this series arranged combination is then connected across the terminals 26 and 27 of the relay coil as shown in FIG. 1. With the neon bulb so connected, it provides a visual indication when the relay 11 is energized. Also connected across these same two terminals is a diode 31 which has its anode connected to terminal 26 of the coil and its cathode to terminal 27 so that it functions as a free-wheeling diode. It can be appreciated that this diode will clip any transient voltage spikes that occur in the circuit when the SCR turns on or off.

Also connected to terminal 26 of the relay coil 16 is a capacitor 32 that is also connected to an optional switch 33. This optional switch can be replaced by a jumper if desired since the mode of operation of the unit, i.e., momentary or latched, is often selected by a user on a permanent basis, such as with a jumper, making the switch unnecessary. However, for purposes of illustration, the switch is utilized in this description. With switch 33 in the position indicated in FIG. 1, the operational mode of the unit is set to its latching mode. In this mode a capacitor 32 is connected across the half-wave rectified supply voltage by a lead 34 from the switch to supply lead 21. As a result the capacitor is charged by the positive voltage pulse of the supply voltage passed by diode 25. During the negative cycle of the AC supply voltage which is blocked by the diode, the capacitor discharges through the relay coil and SCR 28 to keep the latter conductive by preventing the voltage across the SCR from dropping to zero during the negative swing of the AC supply voltage. This will cause the SCR to remain conductive until the next positive voltage pulse is passed by the diode.

Thus, the relay will be latched in an energized position even though the voltage on the gate 28(G) is thereafter absent. Normally the capacitor used in this circuit is approximately two microfarads with working voltage of 150 volts DC.

As indicated the optional switch 33 has two positions. Described above was the latching mode for the unit. When the switch 33 is connected so that capacitor 32 is connected across terminal 26 and 27 of the relay coil, the unit is in the momentary mode. With this parallel connection of the capacitor and coil of the relay, they develop a reactance which prevents armature chatter in the relay. However, the time constant is such that during the negative cycle of the supply voltage blocked by diode 25, the voltage across the SCR will fall to zero thereby causing SCR 28 to stop conducting, until a new trigger voltage is impressed on the gate 28(G).

In FIG. 1 the remainder of the schematic not previously described illustrates the novel switching circuit which provides an unusually high-gain amplifier circuit for controlling relay 11. This circuit uses the secondary 24 of transformer 23 to provide a floating control voltage for the gate 28(G) of the SCR. One lead of this secondary is connected to the anode of diode 35 which has its cathode connected directly to the gate 28(G) of the SCR 28 as illustrated. A resistor 36 of approximately 470 ohms connects the gate of the SCR with its cathode 28(C) and ground as shown in the drawing. Also from the drawings, it can be appreciated that the orientation of diode 35 with its cathode connected to the gate 28(G) of the SCR, any anode-to-gate shorts of the SCR cannot be impressed on the secondary 24 transformer 23. This arrangement provides an additional safety feature to the circuit ensuring that the supply voltage will never appear on the floating probe circuit described herein.

Also the anode of diode 35 is connected to ground through leakage resistor 37 which is generally selected to be in the range of 22,000 ohms. This resistor prevents stray voltage build-up in the floating control circuit due to voltage induced into the probe circuitry by stray magnetic fields or like influences on the probe lead.

The probe lead is connected to the opposite side of the secondary 24 of the transformer 23. It consists of a resistor 38 connected to the secondary and a series connected resistance-capacitance network. This network is composed of capacitor 40 and resistor 39 connected in parallel and is designed to provide a voltage spike in the high impedance circuitry when the probe 41 is initially grounded to provide a positive trigger voltage for the gate 28(G) of the SCR 28.

Probe 41 is connected to the resistance-capacitance network through a suitable lead and it can be appreciated that when the probe is grounded a trigger voltage will be impressed on the gate 28(G) of the SCR 28.

The triggering of the SCR 28 is accomplished by this special secondary circuit just described involves the use of a full floating secondary winding of transformer 23 in combination with the voltage developed by the secondary. This circuitry may be dubbed as one which accomplishes "impedance differential switching".

In operation when the probe is open, that is not grounded, the impedance at the probe end of the secondary 24 is extremely high. At the opposite end of the secondary 24 the impedance is low in the range of 470 ohms positive or 27K ohms negative. As a result of relationship, no voltage is impressed upon the gate 28(G) of the SCR. Further, a very low secondary voltage appears on the probe in the range of 10 volts or less. This is an important characteristic of this unit since with this low voltage the probe can be used directly to sense metal parts which complete the circuit to ground without any electrical etching that might otherwise occur with higher voltages and/or currents on the probe.

Another, and also the primary reason for designing a low voltage, high impedance (low energy) probe, is the human safety aspect. This is of major concern to OSHA, Underwriters Laboratories and CSA (Canadian Standards Association) as in many applications the exposed probe contacts or fixtures are uninsulated and are often subject to being touched by the machine operator.

It can be appreciated when the probe 41 is connected to ground the probe end of the secondary develops a low impedance, approaching zero. As this occurs, the impedance at the opposite end of the secondary will be higher than that on the probe since its condition remains unchanged and an alternating voltage will thus be impressed at the anode of diode 35 which will then pass a positive voltage spike of 2 to 4 volts to the gate 28(G) of the SCR 28. Besides providing a safety blocking diode, the diode 35 also prevents the negative voltage from the probe circuit from turning off the SCR in the latch mode while the probe is grounded.

As indicated above, the resistor 38 and the resistance capacitance network formed by capacitor 40 and resistor 39 provide a very high impedance. Also these components will provide a positive voltage spike to fire the SCR when the probe first contacts ground, thereby ensuring positive triggering of the SCR.

In many control devices, which can use the high gain switching amplifier units described herein, machine operations are also controlled by interrupting cams. For purposes of illustration an interrupting cam 50 is shown in FIG. 1. As this cam unit turns in a timed relationship with the machine's components, its push rod 51 can be used to open switch 52 whereby the amplifier unit 10 will be disconnected from its power source. Under such circumstances even when it is in the latched mode, the relay will be de-energized and the system will remain inactive until an AC supply power is reconnected to reset it with the relay unenergized until the probe is once again grounded.

In FIG. 2 the switching amplifier unit 10 is shown in an application environment with its probe 41 connected to two sensors 60 and 61. These sensors are mounted in a grounded housing 62 and insulated therefrom. However, when either probe is slightly displaced, it will contact the housing and ground probe 41.

In the environment illustrated in FIG. 2, the amplifier unit is used to detect buckling of strip stock A passing between the sensors 60 and 61. If this stock buckles, either sensor 60 or 61 will be displaced and the amplifier unit 10 will open the contacts controlling the driving energy to the strip stock A. Alternatively, if the strip stock A is conductive and at ground potential, mere contact of either of the sensors will immediately actuate the relay due to the high gain of the circuit.

I claim:

1. A switching amplifier unit having a high impedance control input comprising:

a transformer means having a primary and a secondary, said secondary operable to provide a lower voltage output than the input voltage of said primary;

a relay means with an actuating coil having an armature with contact means controlled thereby for operating circuits external to said unit, said relay means having its coil connected in parallel with said primary of said transformer means in a circuit operable to provide an alternating current when connected to a power source;

a solid state switch means having a control gate, said switch means connected in series with said coil in said circuit;

a gate control circuit means connected to one side of said secondary of said transformer means having a diode connected between said one end of said secondary and said control gate, said gate control circuit means operable to develop a low impedance when the other side of said secondary is not grounded; and a probe circuit means including series connected resistance means with a high impedance connected to said other side of said secondary operable to cause said gate control circuit means to develop a high impedance when said probe circuit is grounded whereby a trigger operable voltage is developed in said gate control circuit means to trigger said solid state switch means and activate said relay means.

2. A switching amplifier unit as defined in claim 1 in which the probe control circuit means includes a capacitance connected in parallel with the resistance means operable to enhance the level of the trigger voltage in the gate control circuit means.

3. A switching amplifier unit as defined in claim 1 in which the circuit operable to provide an alternating current when connected to a power source includes a diode connected in series with the coil of the relay means on the opposite end of said coil from the end connected to the solid state switch means.

4. A switching amplifier unit as defined in claim 1 in which the solid state switch means is a silicon controlled rectifier.

5. A switching amplifier unit as defined in claim 4 in which a capacitor has one end connected to the end of the coil of the relay means opposite the end connected to the silicon rectifier and connecting means are provided operable to connect the opposite end of said capacitor alternatively with the cathode and the anode of the silicon controlled rectifier.

6. A switching amplifier unit as defined in claim 1 in which a diode is connected across and in parallel with the coil of the relay means.

7. A switching amplifier unit as defined in claim 1 in which the gate control circuit means has a leakage resistance means connecting the diode therein to ground.

* * * * *